US009797356B2

(12) United States Patent
Kropp et al.

(10) Patent No.: US 9,797,356 B2
(45) Date of Patent: Oct. 24, 2017

(54) AIR-ASSISTED FUEL EVACUATION SYSTEM

(71) Applicant: Toyota Motor Engineering & Manufacturing North America, Inc., Erlanger, KY (US)

(72) Inventors: Justin Alexander Kropp, Cambridge (CA); Gerard Peter van Heuven, Cambridge (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 386 days.

(21) Appl. No.: 14/682,800

(22) Filed: Apr. 9, 2015

(65) Prior Publication Data

US 2016/0298585 A1 Oct. 13, 2016

(51) Int. Cl.

| | |
|---|---|
| ***F02M 55/02*** | (2006.01) |
| ***F02M 55/00*** | (2006.01) |
| ***F02M 65/00*** | (2006.01) |
| ***F02M 69/46*** | (2006.01) |

(52) U.S. Cl.

CPC ..... *F02M 55/025* (2013.01); *F02M 55/002* (2013.01); *F02M 55/004* (2013.01); *F02M 65/00* (2013.01); *F02M 69/465* (2013.01)

(58) Field of Classification Search

CPC ..... F02M 37/0017; F02M 37/0023; F02M 37/0047; F02M 37/0052; F02M 55/002; F02M 55/004; F02M 55/025; F02M 65/00; F02M 69/465

See application file for complete search history.

(56) References Cited

U.S. PATENT DOCUMENTS

| | | | | |
|---|---|---|---|---|
| 5,787,372 | A | 7/1998 | Edwards et al. | |
| 6,314,948 | B1 * | 11/2001 | Cathcart | F02D 7/02 123/479 |
| 6,327,898 | B1 * | 12/2001 | Harris | F02M 25/0818 73/49.2 |
| 2014/0216412 | A1 * | 8/2014 | Seong-Hwa | F02M 37/0017 123/468 |

FOREIGN PATENT DOCUMENTS

| | | | | |
|---|---|---|---|---|
| DE | 10353141 | A1 * | 6/2005 | F02M 63/0215 |
| GB | 2263730 | A * | 8/1993 | F02M 69/08 |
| KR | 2004082496 | A * | 9/2004 | |

* cited by examiner

*Primary Examiner* — Erick Solis
*Assistant Examiner* — Anthony L Bacon
(74) *Attorney, Agent, or Firm* — Christopher G. Darrow; Darrow Mustafa PC

(57) ABSTRACT

A system and method are provided for evacuating fuel from a closed-loop fuel rail after engine testing. The method includes coupling a coaxial hose to a closed-loop fuel rail of an engine. The coaxial hose defines an outer tube section defining an outer passage and surrounding an inner tube section defining an inner passage, and a portion of the inner tube section is inserted a predetermined distance into the fuel rail. The method includes transferring fuel from a fuel supply through the outer passage of the coaxial hose and into the fuel rail for use during an engine testing procedure. After the engine testing procedure is complete, the method includes injecting compressed gas through the inner passage and into the fuel rail, creating a positive pressure. Residual fuel is evacuated from the fuel rail out through the outer passage of the coaxial hose.

20 Claims, 5 Drawing Sheets

AIR-ASSISTED FUEL EVACUATION SYSTEM

TECHNICAL FIELD

The present technology generally relates to systems and methods for the evacuation of residual fuel from an engine fuel rail after engine testing.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Various internal combustion engines and engine assemblies undergo testing procedures after an initial assembly stage and prior to delivery. After testing, any fuel that remains in a fuel rail of the engine during further processing or when the engine is on a main vehicle assembly line could potentially pose a health and/or safety concern. Certain processes for removing residual fuel from a fuel rail of an engine may employ direct suction techniques. While suction removal techniques may work for various open-loop type fuel systems, such techniques, by themselves, are generally not capable of fully removing all or most residual fuel in closed-loop fuel rail systems.

Accordingly, it would be desirable to provide enhanced systems and methods in order to more completely remove residual fuel from closed-loop injector rail chambers after engine testing, in order to minimize or eliminate any risk of fuel leakage during further handling of the engine after testing.

SUMMARY

This section provides a general summary of the disclosure, and is not a comprehensive disclosure of its full scope or all of its features.

In various aspects, the present teachings provide a system for evacuating residual fuel from a fuel rail of an engine. The system may include a coaxial hose having an outer tube section defining an outer passage in fluid communication with a fuel supply, and an inner tube section defining an inner passage in fluid communication with a source of compressed gas. A coupling member may be disposed at a first end of the coaxial hose for removably coupling the coaxial hose to the fuel rail. A valve assembly may be disposed at a second end of the coaxial hose. The valve assembly may be configured to provide selective fluid communication between the outer passage and a fuel supply to transfer fuel to the fuel rail for engine testing. The valve assembly may also provide selective fluid communication between the inner passage and a source of compressed gas for pressurizing the fuel rail and forcefully evacuating residual fuel back through the outer passage upon completion of the engine testing.

In other aspects, the present teachings provide a tube fitting assembly for evacuating fuel from a closed-loop fuel rail of an engine. The assembly may include an outer hose in fluid communication with a fuel supply, and an inner tube disposed within the outer hose and in fluid communication with a source of compressed gas. A coupling member may be provided for removably coupling the outer hose and the inner tube to the fuel rail. An extension member may be fixed to the coupling member and in fluid communication with the inner tube. The extension member may be configured to extend a predetermined distance into the fuel rail when the coupling member is coupled to the fuel rail. A valve assembly may be coupled to the outer hose and inner tube. The valve assembly may provide selective fluid communication between the outer hose and a fuel supply to transfer fuel to the fuel rail for engine testing, and selective fluid communication between the inner tube and a source of compressed gas for evacuating residual fuel remaining in the fuel rail out through the outer hose upon completion of the engine testing.

In still other aspects, the present teachings provide a method for evacuating fuel from a closed-loop fuel rail after engine testing. The method may include coupling a coaxial hose to a closed-loop fuel rail of an engine. The coaxial hose may include an outer tube section defining an outer passage and surrounding an inner tube section defining an inner passage. A portion of the inner tube section may be inserted a predetermined distance into the fuel rail. The method may include transferring fuel from a fuel supply through the outer passage of the coaxial hose and into the fuel rail for use during an engine testing procedure. After the engine testing procedure is complete, the method may include injecting compressed gas through the inner passage and into the fuel rail, creating a positive pressure. Residual fuel may be evacuated from the fuel rail out through the outer passage of the coaxial hose.

Further areas of applicability and various methods of enhancing fuel evacuation from a closed loop system will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

Figure 1:
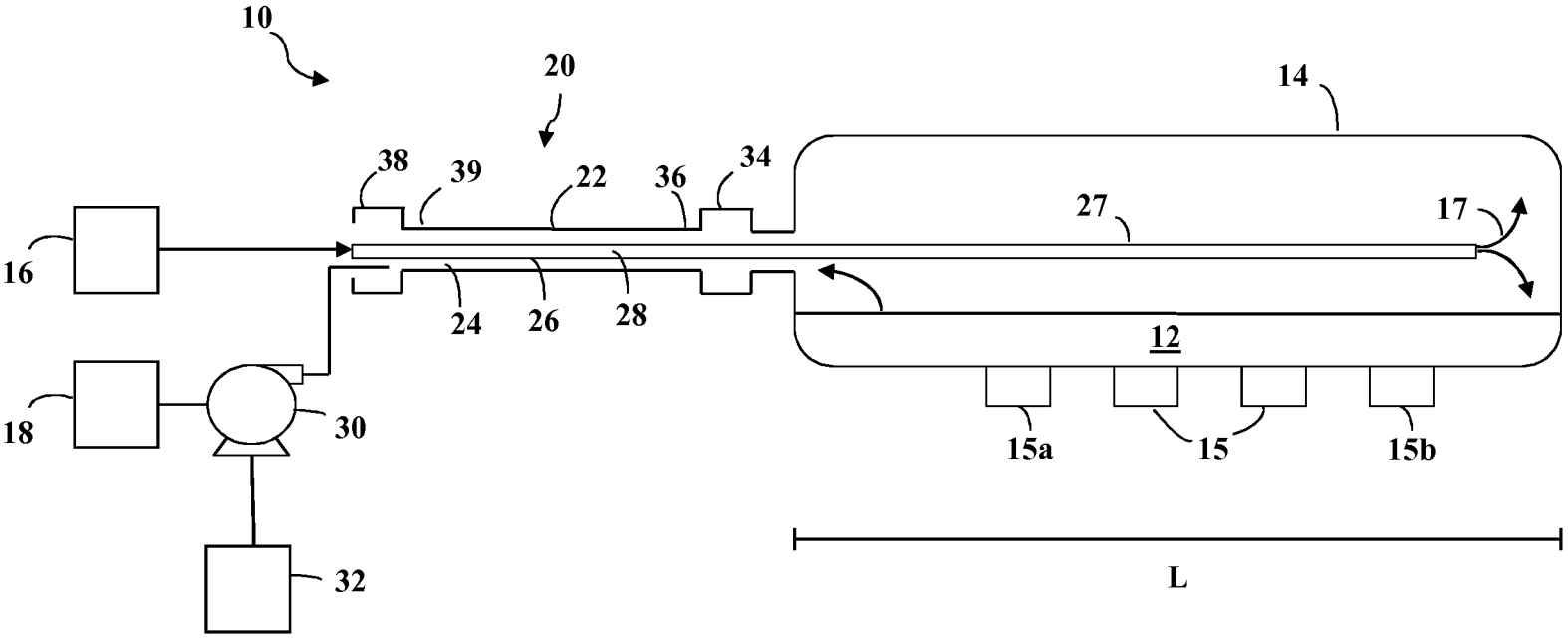
FIG. 1 is a simplified schematic view of an exemplary system for evacuating residual fuel from an engine fuel rail according to various aspects of the present technology.

It should be noted that the figures set forth herein are intended to exemplify the general characteristics of materials, methods, and devices among those of the present technology, for the purpose of the description of certain aspects. These figures may not precisely reflect the characteristics of any given aspect, and are not necessarily intended to define or limit specific aspects within the scope of this technology. Further, certain aspects may incorporate features from a combination of figures.

DETAILED DESCRIPTION

The following description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple aspects having stated features is not intended to exclude other aspects having additional features, or other aspects incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an aspect can or may comprise certain elements or features does not exclude other aspects of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment is included in at least one embodiment or aspect. The appearances of the phrase "in one aspect" (or variations thereof) are not necessarily referring to the same aspect or embodiment.

The present technology generally relates to systems and methods for the evacuation of residual fuel that may remain in an engine fuel rail of an internal combustion engine after the engine is tested and prior to further downstream assembly or manufacturing steps. The systems and methods described herein and represented in the accompanying figures are primarily for use with closed-loop systems. However, it is envisioned that they may also be useful with certain open-loop systems. As such, the systems and methods described herein may be modified by different combinations and designs as may be preferred for different uses. It is envisioned that the systems and devices may be set-up specifically for use at static, or non-moving stations, or they may be configured specifically for use in or with a moving assembly line.

FIG. 1 is a simplified schematic view of an exemplary system 10 for evacuating residual fuel 12 from an engine fuel rail 14 according to various aspects of the present technology. As shown in FIG. 1, the system 10 may include a source of compressed gas 16, and a fuel supply 18. A coaxial hose 20 may be provided including an outer tube section 22 defining an outer passage 24 in fluid communication with the fuel supply 18. The coaxial hose 20 may further include an inner tube section 26 defining an inner passage 28 in fluid communication with the source of compressed gas 16. In certain instances, preassembled or pre-manufactured coaxial hoses, or portions thereof may be used. In other aspects, the coaxial hoses may be custom made or are retrofit or rebuilt from other uses.

The compressed gas 16 may include compressed air, nitrogen, inert gas, or any other suitable non-flammable gas. In various aspects, a maximum pressure of the compressed gas will generally be related to a tolerable limit as set forth by the components of the fuel delivery system, and as used in the engine under normal or standard operating conditions. A minimum pressure of the compressed gas may be determined through trial and confirmation of residual fuel. In general, it is envisioned that air or gas pressures provided near the maximum pressure limit will be the most effective in evacuating the residual fuel from the fuel rail. The compressed gas 16 may be stored in appropriate tanks, or one or more compressors may be used to provide a suitable source of a compressed gas in order to pressurize the engine fuel rail 14.

The fuel supply 18 may include any appropriate fuel or mixture of fuel and oil for combustion in the engine. As shown, one or more fuel transfer devices 30 may be provided to pump fuel into the fuel rail 14. In various aspects, one or more of the transfer devices 30 may additionally or alternatively be used to engage a vacuum in order suction out or remove at least a portion of the residual fuel 12 back to the fuel supply 18 or other suitable reservoir 32.

In various aspects, a coupling member 34 may be disposed at a first end 36 of the coaxial hose 20 for removably coupling the coaxial hose 20. The coupling member may be configured to couple or otherwise secure both the outer hose or outer tube section 22, as well as the inner tube or inner tube section 26, to the fuel rail 14. A valve assembly 38 may be disposed at a second end 39 of the coaxial hose 20. As will be discussed in more detail below, the valve assembly 38 may be configured to provide selective fluid communication between the outer passage 24 and a fuel supply 18 to transfer fuel to the fuel rail 14 for engine testing. The valve assembly 38 may also be configured to provide selective fluid communication between the inner passage 28 and the source of compressed gas 16 for pressurizing the fuel rail 14 and evacuating residual fuel 12 back through the outer passage 24 to the fuel supply 18 or other suitable reservoir 32 upon completion of the engine testing. The valve assembly 38 may be connected to one or more controllers for controlling the direction and flow of fuel and/or compressed gas to and from the fuel rail 14.

Figure 2:
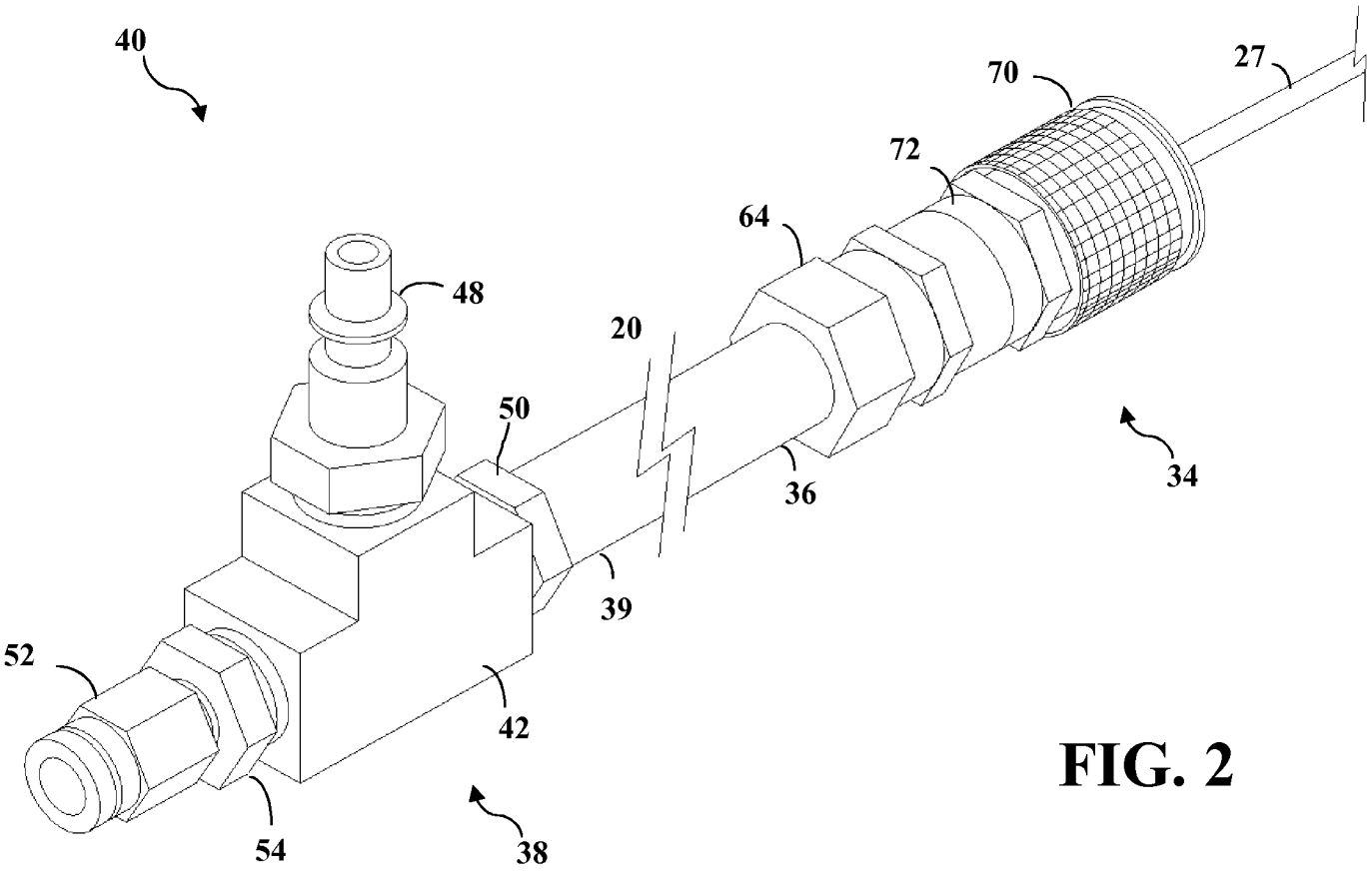
FIG. 2 is a partial perspective view of an exemplary tube fitting assembly according to various aspects of the present technology.
Figure 3:
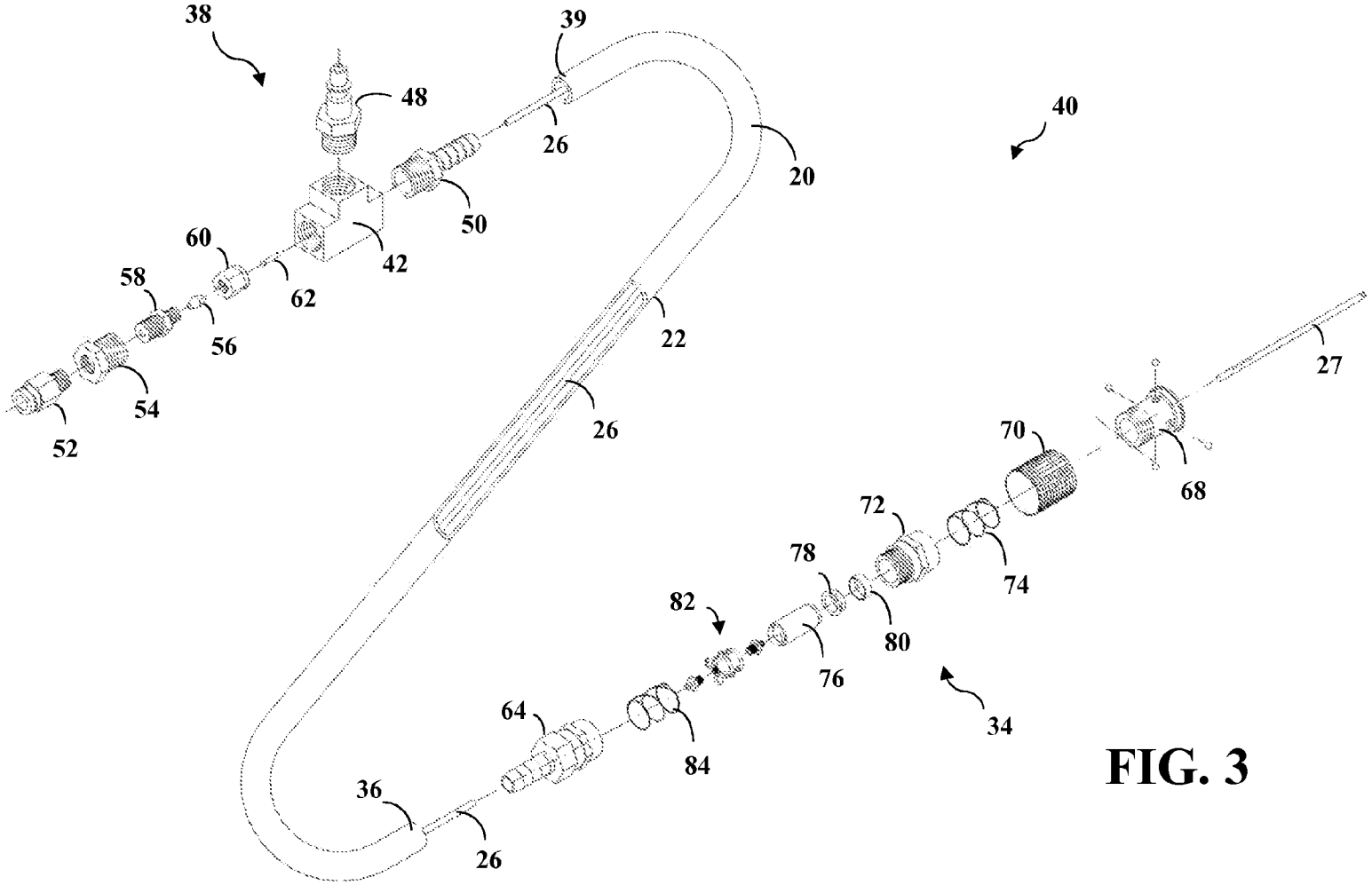
FIG. 3 is an exploded perspective view of the tube fitting assembly as shown in FIG. 2.
Figure 4:
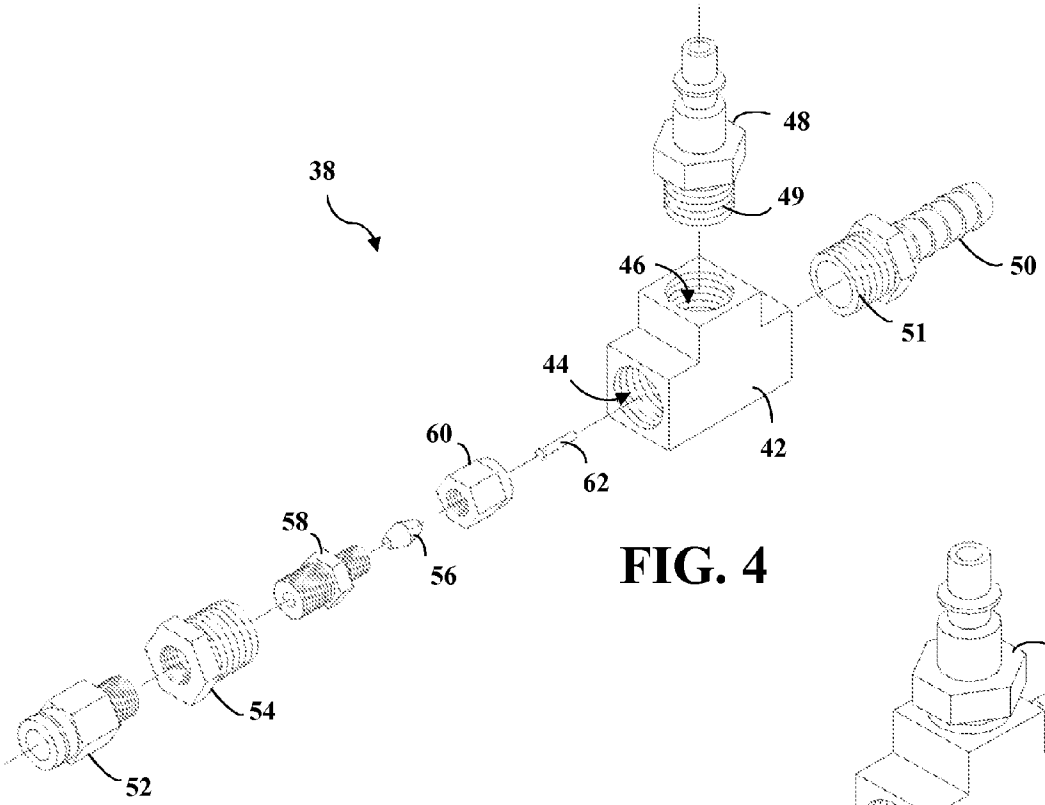
FIG. 4 is a magnified, exploded view of a valve assembly portion of the tube fitting assembly as shown in FIGS. 2 and 3.
Figure 5:
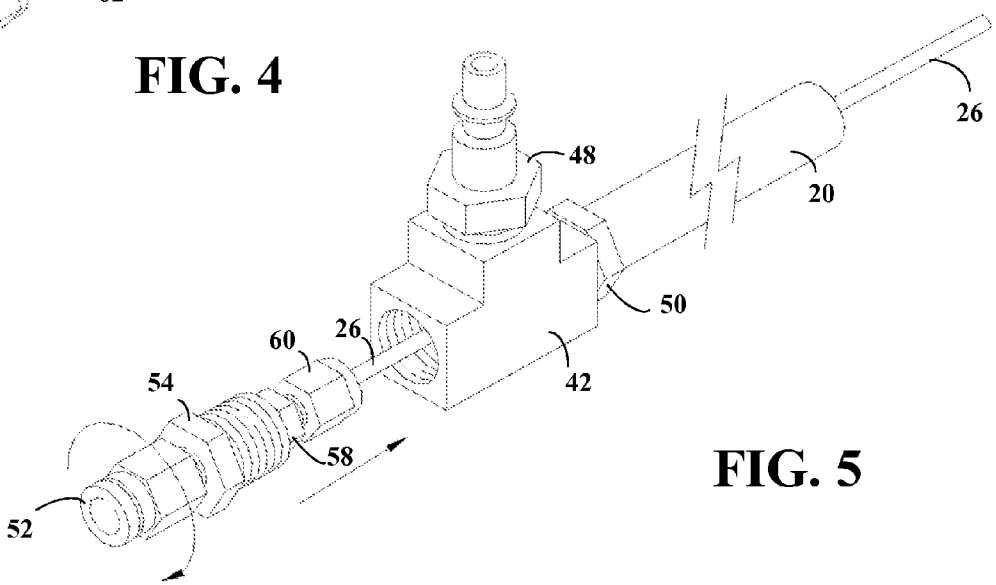
FIG. 5 is a partial perspective view of the tube fitting assembly of FIGS. 2 and 3, illustrating the connection of an inner tube portion to the valve assembly.

FIG. 2 is a partial perspective view of an exemplary tube fitting assembly 40 according to various aspects of the present technology. FIG. 3 is an exploded view of the tube fitting assembly 40 of FIG. 2, which illustrates further details of the assembly 40. FIG. 4 is a magnified, exploded view of the valve assembly 38 portion of the tube fitting assembly 40 of FIG. 3. FIG. 5 is another partial perspective view of the tube fitting assembly 40 of FIG. 2, illustrating further details of the connection of the inner tube 26 or inner tube section to the valve assembly 38.

With reference to FIGS. 2-5, the valve assembly 38 may include a valve fitting 42 that may define a first port 44 providing fluid communication with the outer passage 24 and a second port 46 providing fluid communication with the inner passage 28. As shown, the fitting 42 may be a brass tee fitting providing the first port 44 in a generally perpendicular relationship with the second port 46. It is envisioned that valve fittings having other configurations may also be used.

In various aspects, a quick-disconnect type plug 48 may be threadably coupled to the top of the valve fitting 42, ultimately providing fluid communication with the fuel supply 16 using an appropriate tube or hose (not shown). Similarly, a barb plug 50 may be threadably coupled to a first side of the valve fitting 42 and the outer tube section 22 of the coaxial hose 20 providing fluid communication to the outer passage 24. The respective threads 49, 51 of the quick-disconnect plug 48 and the barb plug 50 (as well as other threads depicted in FIGS. 2-7) may be wrapped with appropriate thread sealing tape prior to being inserted into the valve fitting 42 and appropriately tightened.

As shown in FIGS. 4-5, a suitable union member 52 may be coupled to a bushing 54, such as a brass bushing, in order to couple the valve fitting 42 to an appropriate tube or hose (not shown) in fluid communication with the source of compressed gas 16. As best shown in FIG. 4, a ferrule 56 may be used in conjunction with a connector base 58 and a connector cap 60 to secure the inner tube section 26 to the valve fitting 42. It may be desirable to include a plastic or brass push tube insert 62 to protect the inner tube section 26 and assist in keeping the inner passage 28 open.

Figures 6, 7:
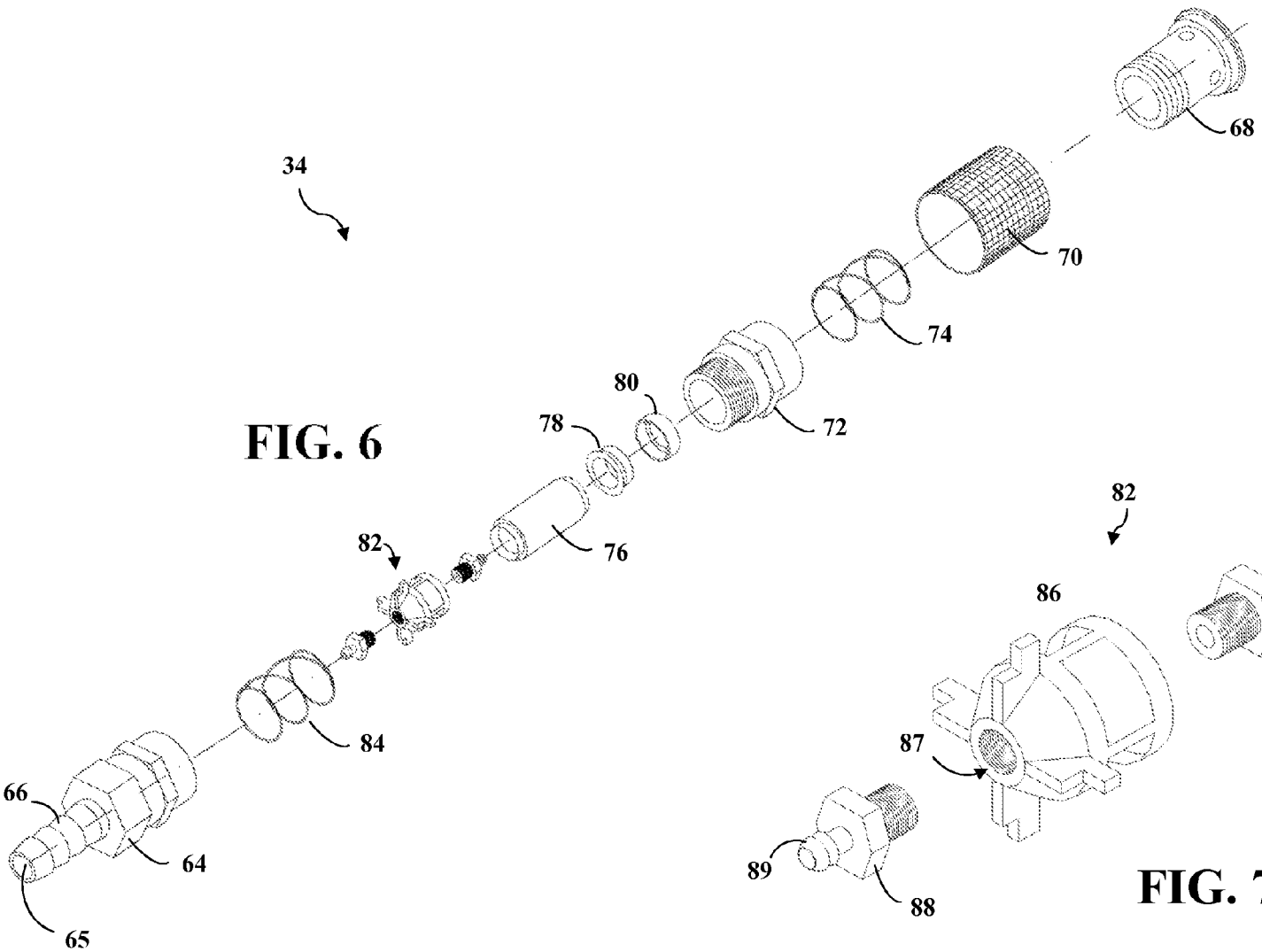
FIG. 6 is an exploded view of a coupling member portion of the tube fitting assembly as shown in FIGS. 2 and 3.
FIG. 7 is a magnified, exploded view of a plunger assembly portion of the coupling member portion shown in FIG. 6.

FIG. 6 is an exploded view of a coupling member 34 portion of the tube fitting assembly 40 of FIG. 3. Attaching the coupling member 34 to an appropriate fitting on the fuel rail 14 allows the tube fitting assembly to serve as a supply of fuel to the engine during testing, and to serve as a return for evacuating the residual fuel after engine testing is complete. As shown, the coupling member 34 may include an appropriate coupler base 64 that defines an aperture 65 to accept the inner tube section 26 and a barb portion 66 to couple the outer hose 22, or outer tube section of the coaxial hose 20. As should be understood, the aperture 65 should be sufficiently sized to accommodate the inner tube section 26 as well as to allow for the bi-directional flow of fuel to and from the fuel rail 14.

The coupler member 34 may also include a coupler housing 68 connected to a moveable release barrel 70 and outer spacer 72 with a biasing member 74 there between. A chamfered inner spacer 76 may be provided within the outer spacer 68 with an appropriate gasket 78 and gasket cap 80 as needed.

FIG. 7 is a magnified, exploded view of a movable plunger assembly 82 portion of the coupling member 34 shown in FIG. 6, which is disposed between the coupler base 64 and coupler housing 68 with a biasing member 84. The plunger assembly 82 may be biased in a first direction in order to restrict a flow of fuel through the coaxial hose 20 when the coupling member 34 is not attached to the fuel rail 14, and biased in a second direction to permit the flow of fuel through the coaxial hose 20. For example, fuel flows around an exterior of the plunger 86 and compressed gas flows through an interior bore 87 defined within the plunger 86.

The plunger assembly 82 may include a main plunger body 86 and opposing barbs connections 88, 90 threadedly engaged to the interior bore 87 of the plunger body 86. A proximal barb 88 may include an end 89 that is configured to connect to the inner tube section 26. A distal barb 90 may include an end 91 that is configured to connect to an extension member 27. When the coupling member 34 is connected to the fuel rail 14, the extension member 27 is inserted a predetermined distance into the fuel rail 14, configured to direct pressurized gas 17 therein, and assist a forceful evacuation of the residual fuel 12 out from the fuel rail 14.

It is also envisioned that in certain aspects, appropriate fittings and tubing sizes may be selected such that the inner tube section 26 may be one continuous member extending through the coaxial tube 20 and ultimately into the fuel rail 14, such that an extension may not be needed. In still other aspects, it may be desirable to have more than one extension piece component, with various connectors, which may allow for simple replacement or repair of individual sections, should areas become damaged or worn after many uses.

With renewed reference to FIG. 1, the fuel rail 14 may provide fuel to a plurality of spaced-apart fuel injectors 15. In various aspects, the inner tube section 26, or extension member 27 thereof, is inserted a predetermined linear distance with respect to an overall length "L" dimension of the fuel rail 14. For example, the extension member 27 may be provided with a length such that when inserted into the fuel rail 14 it extends a distance of from about 60% to about 95%, or from about 70% to about 90%, or greater than about 80% of the length "L" of the fuel rail 14. In various aspects, the length "L" of the extension member 27 is long enough so as to terminate a distance beyond the last injector position in the fuel rail. Inserting the extension member 27 such a distance may provide optimal turbulent flow of compressed gas or air sufficient to force the residual fuel 12 out of the fuel rail via the outer passage 24 of the coaxial hose 20. In still other aspects, the fuel rail 14 may be provided with a plurality of spaced-apart fuel injectors including a proximal position fuel injector 15*a* and a distal position fuel injector 15*b*. The portion of the inner tube section 26, or the extension member 27 fixed to the coupling member 34, may be inserted a distance into the fuel rail 14 such that it extends beyond the distal position fuel injector 15*b* as shown in FIG. 1.

Although various materials may be used depending on fuels and operating conditions, in certain aspects, it may be preferred that the outer hose 22 or outer tube section of the coaxial hose 20 may be a fuel grade rubber material, or equivalent material. The inner tube 26 or inner tube section of the coaxial hose 20 may be a fuel grade polyurethane tube, or equivalent material; and the extension member 27 may be a fuel grade nylon tube, or equivalent material. The various fittings, gaskets, and connectors may comprise brass or any other suitable metal or plastic suitable for use with fuel.

With general reference to FIGS. 1-7, various methods for evacuating residual fuel from a closed-loop fuel rail after engine testing according to the present technology will now be described. The methods may first include coupling a coaxial hose 20 to a closed-loop fuel rail 14 of an internal combustion engine. As described in detail above, an exemplary coaxial hose 20 may include an outer tube section 22, or outer hose defining an outer passage 24 surrounding an inner tube section 26, or inner tube defining an inner passage 28. While connecting the coupling member 34 to the fuel rail 14, a portion of the inner tube section 26 may be inserted a predetermined distance into the fuel rail 14. As explained above, in certain aspects, the portion of the inner tube inserted into the fuel rail may be a separate extension member 27 fixedly or removably secured to the coupling member 34.

The method may include transferring fuel from a fuel supply 18 through the outer passage 26 of the coaxial hose 20 and into the fuel rail 14 for use during one or more engine testing procedure. At all times while fuel is present in the fuel rail and connected to the coaxial tube, it may be desirable to maintain a slight pressure of gas in the inner tube in order to prevent backflow of fuel through the inner tube. Alternative, the inner tube may be provided with a shut-off, for example at or near the valve assembly 38.

After the engine testing procedure is complete, the method may first include removing at least a portion of the residual fuel using a direct suctioning technique. By way of example, one of the transferring devices 30, described above, may be configured to draw a vacuum and remove at least a portion of the residual fuel 12 through the outer passage 24. Accordingly, the methods may include engaging a vacuum source in fluid communication with the outer passage 24 of the coaxial hose 20 prior to injecting the compressed gas. Due to the closed-loop nature of the system, it is envisioned that a certain amount of air or gas may need to be available for entry into the fuel rail during the vacuum process to replace the removed fuel and displaced air or gas.

The methods may then include injecting a compressed gas, such as compressed air or nitrogen, through the inner passage 28 and into the fuel rail 14, creating a positive pressure, and optionally creating a turbulent flow therein. The remaining residual fuel may then be evacuated from the fuel rail 14 out through the outer passage 24 of the coaxial hose 20. The valve assembly 38 may be provided with one or more suitable shut-off valves or stop devices (not shown) in order to control a pressure buildup and release, if desired.

In various aspects, the methods may include repeated, or alternating steps of drawing out residual fuel using the vacuum source and injecting the compressed gas into the fuel rail. In certain aspects, the steps of injecting the compressed gas through the inner tube section and into the fuel rail, and evacuating residual fuel from the fuel rail out through the outer tube section, may be performed concurrently.

The methods described herein may be manually performed or incorporated into an automated system, as desired. With certain methods, it may be desirable to monitor or inspect the fluid removed from the outer passage in order to determine whether it still includes an amount of fuel, or is substantially gas or air, such that the removal of residual fuel can be considered complete, and the injection of compressed gas step stopped. In still other aspects, it may be desirable to engage the vacuum and/or inject the compressed gas into the fuel rail for a predetermined period of time prior to decoupling the coaxial hose from the closed loop fuel rail and returning the engine to the remaining assembly stages.

The foregoing description of the embodiments has been provided for purposes of illustration and description. It is not intended to be exhaustive or to limit the technology. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. It should be understood that certain well-known processes, device structures, and technologies may not have been described in detail herein, but should be readily understood by those of ordinary skill in the art.

What is claimed is:

1. A system for evacuating residual fuel from a fuel rail of an engine, the system comprising:

a source of compressed gas;

a coaxial hose including an outer tube section defining an outer passage in fluid communication with a fuel supply and an inner tube section defining an inner passage in fluid communication with the source of compressed gas;

a coupling member disposed at a first end of the coaxial hose for removably coupling the coaxial hose to the fuel rail; and a valve assembly disposed at a second end of the coaxial hose and configured to provide:

selective fluid communication between the outer passage and a fuel supply to transfer fuel to the fuel rail for engine testing; and selective fluid communication between the inner passage and the source of compressed gas for pressurizing the fuel rail and evacuating residual fuel back through the outer passage upon completion of the engine testing.

2. The system according to claim 1, wherein the valve assembly comprises a valve fitting defining a first port providing fluid communication with the outer passage, and a second port providing fluid communication with the inner passage.

3. The system according to claim 2, wherein the valve fitting comprises a brass tee fitting.

4. The system according to claim 1, further comprising an extension member fixed to the coupling member and in fluid communication with the inner passage, the extension member extending a predetermined linear distance into the fuel rail when the coaxial hose is coupled to the fuel rail.

5. The system according to claim 4, wherein the predetermined linear distance is greater than about 80% of a length dimension of the fuel rail.

6. The system according to claim 4, wherein the inner tube section comprises a polyurethane tube, the outer section comprises a rubber hose, and the extension member comprises a nylon tube.

7. The system according to claim 1, wherein the fuel rail is part of a closed-loop structure.

8. A tube fitting assembly for evacuating fuel from a closed-loop fuel rail of an engine, the assembly comprising:

an outer hose in fluid communication with a fuel supply;

an inner tube disposed within the outer hose and in fluid communication with a source of compressed gas;

a coupling member for removably coupling the outer hose and the inner tube to the fuel rail;

an extension member fixed to the coupling member and in fluid communication with the inner tube, the extension member configured to extend a predetermined distance into the fuel rail when the coupling member is coupled to the fuel rail; and a valve assembly coupled to the outer hose and inner tube, the valve assembly providing selective fluid communication between the outer hose and a fuel supply to transfer fuel to the fuel rail for engine testing, and the valve assembly further providing selective fluid communication between the inner tube and a source of compressed gas for evacuating residual fuel remaining in the fuel rail out through the outer hose upon completion of the engine testing.

9. The fitting assembly according to claim 8, extension member comprises a length greater than about 80% of a length dimension of the fuel rail.

10. The fitting assembly according to claim 8; wherein the inner tube comprises a polyurethane tube, the outer hose comprises a rubber hose, and the extension member comprises a nylon tube.

11. A method for evacuating fuel from a closed-loop fuel rail after engine testing, the method comprising:

coupling a coaxial hose to a closed-loop fuel rail of an engine, the coaxial hose including an outer tube section defining an outer passage and surrounding an inner tube section defining an inner passage, a portion of the inner tube section being inserted a predetermined distance into the fuel rail;

transferring fuel from a fuel supply through the outer passage of the coaxial hose and into the fuel rail for use during an engine testing procedure;

after the engine testing procedure is complete, injecting compressed gas through the inner passage and into the fuel rail, creating a positive pressure; and evacuating residual fuel from the fuel rail out through the outer passage of the coaxial hose.

12. The method according to claim 11, further comprising removing at least a portion of the residual fuel prior to injecting compressed gas through the inner passage.

13. The method according to claim 12, wherein the removing at least a portion of the residual fuel comprises engaging a vacuum source in fluid communication with the outer passage of the coaxial hose and drawing out residual fuel.

14. The method according to claim 13, further comprising repeated alternating steps of drawing out residual fuel using the vacuum source and injecting compressed gas into the fuel rail.

15. The method according to claim 11, wherein the coaxial hose comprises a coupling member disposed at a first end for removably coupling the coaxial hose to the fuel rail, and a valve assembly disposed at a second end for selectively directing fuel and compressed gas through respective passages of the coaxial hose.

16. The method according to claim 15, wherein the valve assembly comprises a first port providing selective fluid communication between the outer passage and the fuel supply, and a second port providing selective fluid communication between the inner passage and a source of compressed gas.

17. The method according to claim 15, wherein the fuel rail comprises a plurality of spaced-apart fuel injectors including a proximal position fuel injector and a distal position fuel injector, and the portion of the inner tube section comprises an extension member fixed to the coupling member and inserted a distance into the fuel rail beyond the distal position fuel injector.

18. The method according to claim 11, wherein the predetermined distance is greater than about 80% of a length dimension of the fuel rail.

19. The method according to claim 11, comprising injecting compressed gas into the fuel rail for a predetermined period of time prior to decoupling the coaxial hose from the closed-loop fuel rail.

20. The method according to claim 11, wherein the steps of injecting the compressed gas through the inner tube section and into the fuel rail, and evacuating residual fuel from the fuel rail out through the outer tube section are performed concurrently.

* * * * *